US012077893B2

(12) United States Patent
Huber

(10) Patent No.: US 12,077,893 B2
(45) Date of Patent: Sep. 3, 2024

(54) DEVICE FOR INTRODUCING A RUNNING MATERIAL WEB INTO A TENTER MACHINE

(71) Applicant: Texmag GmbH Vertriebsgesellschaft, Thalwil (CH)

(72) Inventor: Josef Georg Huber, Mering (DE)

(73) Assignee: Texmag GmbH Vertriebsgesellschaft, Thalwil (CH)

( * ) Notice: Subject to any disclaimer, the term of this patent is extended or adjusted under 35 U.S.C. 154(b) by 34 days.

(21) Appl. No.: 17/968,846

(22) Filed: Oct. 19, 2022

(65) Prior Publication Data

US 2023/0129064 A1 Apr. 27, 2023

(30) Foreign Application Priority Data

Oct. 25, 2021 (DE) ..... 102021005293.5

(51) Int. Cl.
*D06C 3/02* (2006.01)
*B65H 23/022* (2006.01)
*B65H 23/032* (2006.01)

(52) U.S. Cl.
CPC ..... *D06C 3/026* (2013.01); *B65H 23/022* (2013.01); *D06C 3/028* (2013.01); *B65H 23/032* (2013.01); *B65H 2402/31* (2013.01); *B65H 2511/212* (2013.01)

(58) Field of Classification Search
CPC ..... D06C 3/026; D06C 3/028; D06C 3/025; D06C 3/00; D06C 3/02; D06C 3/021; D06C 3/023; D06C 3/062; D06C 3/065; B65H 23/032; B65H 23/0324; B65H 23/022;

(Continued)

(56) References Cited

U.S. PATENT DOCUMENTS 408,758 A * 8/1889 Scholfield ..... D06C 3/00 26/77
1,163,565 A * 12/1915 Schwartz ..... D06C 3/026 200/DIG. 11

(Continued)

FOREIGN PATENT DOCUMENTS

CN 204676306 U * 9/2015
DE 3305893 A1 * 8/1984

(Continued)

OTHER PUBLICATIONS

German Search Report for DE 10 2021 005 293.5, with English translation.

*Primary Examiner* — Amy Vanatta
(74) *Attorney, Agent, or Firm* — Joseph E. Maenner; Maenner & Associates, LLC

(57) ABSTRACT

A device (1) is used for introducing a running material web (3) into a tenter machine. The device (1) comprises at least one tiltable cheek (12) which receives the material web (3). This cheek (12) is tilted by at least one control element (13) by means of at least one actuator (19). This control element (13) engages on the one hand on the cheek (12) and on the other hand on the frame (17). Angle sensors (32) record the angle between the cheek (12) and the control element (13) as well as between the frame (17) and the control element (13). These angles are delivered to calculation means (66') for calculating the difference of the two recorded angles.

9 Claims, 4 Drawing Sheets

(58) Field of Classification Search
CPC ..... B65H 23/0204; B65H 2402/31; B65H 2511/21; B65H 2511/212
USPC ..... 26/76, 75, 89, 90, 91, 93, 96, 51.4, 51.5
See application file for complete search history.

(56) References Cited

U.S. PATENT DOCUMENTS

| | | | | | |
|---|---|---|---|---|---|
| 3,150,431 | A * | 9/1964 | Fazis | D06C 3/00 | 226/20 |
| 3,216,081 | A * | 11/1965 | Leimer | D03J 1/22 | 226/19 |
| 3,482,750 | A * | 12/1969 | Glasz | D06C 3/028 | 226/19 |
| 3,943,612 | A | 3/1976 | Campbell | | |
| 4,646,402 | A * | 3/1987 | Gierse | D06C 3/025 | 26/96 |
| 4,817,254 | A * | 4/1989 | Poterala | D06C 3/028 | 26/51.3 |
| 6,038,750 | A * | 3/2000 | Pabst | D06C 3/026 | 26/91 |
| 2017/0320692 | A1 | 11/2017 | Swanson et al. | | |

FOREIGN PATENT DOCUMENTS

| | | |
|---|---|---|
| DE | 202010014335 | 1/2011 |
| DE | 202020001243 | 8/2021 |
| EP | 3141650 A1 * | 3/2017 |

* cited by examiner

DEVICE FOR INTRODUCING A RUNNING MATERIAL WEB INTO A TENTER MACHINE

CROSS-REFERENCE TO RELATED APPLICATION

The present application claims priority to German Patent Application no: 10 2021 005 293.5, filed Oct. 25, 2021, which is incorporated herein by reference in its entirety.

FIELD OF THE INVENTION

The invention relates to a device for introducing a running material web into a tenter machine, which comprises at least one tiltable cheek. The latter receives the material web and guides it into the tenter machine. In this case, the location of a web edge of the material web is recorded and the tiltable cheek is aligned with the web edge of the material web so that the latter can run directly onto the cheek. For this purpose, a regulator which regulates the position of the cheek to the material web edge location under the influence of an actuator is provided. In order to initiate the desired tilting movement of this at least one cheek, it can be tilted by at least one control element with at least one actuator. This at least one control element engages on the one hand on a fixed frame and on the other hand on the at least one cheek. Measuring means for recording a tilt angle of the at least one cheek are furthermore provided, particularly in order to handle hazardous operating states of the device.

BACKGROUND OF THE INVENTION

DE 20 2010 014 335 U1 discloses a device of the generic type for introducing a running material web into a tenter machine. This device comprises two tiltable cheeks, which can each be tilted by a control element respectively by means of an actuator. For this purpose, the control element engages on the one hand with a pinion on a rack held on a frame, while an opposite end is respectively connected to one of the cheeks. In this way, the cheeks can be adjusted with a corresponding actuation force while being accurately positioned in their angular location. Limit switches are furthermore provided on the cheeks in order to detect extreme cheek setting angles. These limit switches are actively connected to web running regulation. One of the limit switches is used, for example, for the emergency stop signal generation, in order to shut down the entire tenter machine before the cheek angle enters an unallowed range which could cause damage to the device. This device has widely proven useful in practice and forms the starting point of the present invention.

BRIEF SUMMARY OF THE INVENTION

The object of the invention is to provide a device of the type mentioned in the introduction, which is distinguished by a simpler structure and a reduced mounting and set-up time, with the further possibility of straightforwardly carrying out other adaptations as required during operation in order to make the device more efficient overall.

This object is achieved according to the invention by the following features.

A device according to the invention is used to introduce a running material web into a tenter machine. A running material web is in this case intended to mean a two-dimensional product which is transported in a running direction, particularly in order to be subjected to a processing operation. The running material web may consist of any desired materials, a textile material web preferably being envisaged. A tenter machine, which is not to be regarded as part of the subject matter of the invention, is a machine which receives the running material web at its edge regions and draws it through itself. Such tenter machines have different working widths transversely to the running direction of the running material web, which necessitates the introduction of the running material web into the tenter machine. For this purpose, the device comprises at least one tiltable cheek which receives the material web and correspondingly delivers it to the tenter machine. The reception of the material web itself may in this case be carried out in various ways, pins or clamps being envisaged in particular. This list is only exemplary, however, and should not be regarded as exhaustive. The effect achieved by the tiltability of this cheek by means of the at least one control element with at least one actuator is that the edge of the running material web can be matched to the width of the tenter machine during its running. In this way, the running material web is delivered correctly to the subsequent tenter machine. Since the running material web may under certain circumstances exert a corresponding counter-force on the cheeks due to resilient forces, it is held in or tilted against the desired position by the at least one control element with at least one actuator, which applies the corresponding actuation force for this purpose. The actuator in this case engages on the one hand on a fixed frame of the device and on the other hand on the at least one cheek, in order to be able to support the resilient restoring force of the running material web. Depending on the material properties of the running material web and the delivery thereof, as a function of its web width, and position to the device, the tilt angle of the at least one cheek is tilted by correspondingly driving the at least one actuator. It may in this case occur that the at least one cheek enters an impermissible tilt angle range. This may cause damage to the running material web or damage to the device, or the subsequent tenter machine. For this reason, such operating states must be reliably prevented. For this purpose, the device comprises measuring means for recording the tilt angle of the at least one cheek, with which the angular location of the at least one cheek is recorded. In this case, it is entirely sufficient for the measuring means to record a relative tilt angle of the at least one cheek. Although an absolute angle value therefore cannot be determined, a relative angle, that is to say in particular an angle change, can be determined in this way and converted by suitable calculation operations into corresponding signals. The evaluation of these signals, however, becomes simpler when the measuring means determine an absolute angle so that certain calculation steps can be omitted. In order to shorten the mounting and set-up time and for further adaptation possibilities during ongoing operation of this device, the measuring means comprise angle sensors which record on the one hand an angle between the at least one cheek and the at least one control element, and on the other hand the angle between the frame and the at least one control element. Since the two angle sensors respectively take the at least one control element as a reference for the angle measurement, they may be provided in the region of the at least one control element, preferably on or inside the latter. Additionally provided calculation means then calculate the difference of the two recorded angles, which then corresponds to the cheek angle relative to the frame. In this way, the mounting and set-up of the device are substantially shortened and simplified. Furthermore, the device therefore becomes more compact and costs may be saved. It is, in particular, also possible to adapt the angle monitoring further in relation to extreme cheek setting angles of the cheek during ongoing operation, without the material web having to be stopped for this, or other adaptations being necessary. Since the adaptation of the device to different operating requirements is then carried out substantially more simply, adaptation is thus possible even during operation, in particular when changing the type of material web. The effect achieved in this way is that the tilting range of the at least one cheek can be utilised even better, if the physical properties of the material web allow this. Nevertheless, it is also possible to run more critical material webs, for which the corresponding angle threshold values are then adapted accordingly.

Preferably, at least one of the angle sensors is configured as an analogue sensor. This at least one angle sensor therefore has the potential option of recording the respective angle with a high resolution, so that different operating states of the at least one cheek may readily be detected and assigned.

It is furthermore conceivable to configure at least one of the angle sensors as a digital sensor which can output more than two different angle values. A digital sensor has the advantage that numerical post-processing of the sensor data is possible, which in particular simplifies the calculation means in terms of their structure.

Preferably, the at least one angle sensor can output more than four different angle values, so as to thus allow sensitive angle recording which can be adapted to different operating states.

In order to determine the current operating state of the device from the angle values, or the calculated output value of the calculation means, it is advantageous for the calculated difference to be compared with at least one first threshold value. If this is exceeded, further tilting of the at least one cheek is prevented. This prevents the at least one cheek from being tilted too far and therefore being damaged.

It is furthermore advantageous for the difference calculated by the calculation means to be compared with at least one second threshold value, the at least one cheek being tilted into a location which lies closer to a neutral location when this is exceeded, so that the angle between the cheek and the web running direction is reduced. This is intended to prevent the at least one cheek from being tilted further, for example by a width setting of the tenter machine, and therefore entering a state in which it could be damaged.

Furthermore, it is advantageous for the difference calculated by the calculation means to be compared with at least one third threshold value, an alarm signal being transmitted to the tenter machine when this is exceeded. This generally achieves the effect that the tenter machine is turned off. This may in particular be necessary, for example, if the tenter machine is set further in its width and the cheek cannot be tilted according to a second threshold value in the direction of a neutral location. An advantage of the subject matter of the invention is in this case that the said extraordinary operating states can be recorded by the two angle sensors without a separate sensor being required for each individual operating state.

The said threshold values are compared with the result of the angle measurement so as to generate corresponding signals. Preferably, at least one comparator and/or at least one window comparator is used for the comparison.

In order to increase the operational reliability, it is furthermore advantageous for the device to comprise at least one further sensor, which records the angle between the at least one cheek, on the one hand, and the frame on the other hand. Using this further sensor, the angle sensors together with the calculation means can be double-checked, for example in order to identify failure of the angle sensors or of the calculation means and to react accordingly thereto.

In the simplest case, this further sensor is used for plausibility checking, so that its recorded sensor value is not in general used for determining the operating state.

Lastly, it is advantageous for the angle sensors together with the at least one control element to be accommodated in a common housing. In particular, this simplifies the structure of the device. Lastly, this measure achieves the effect that the entire device becomes less sensitive to interference since long cabled lines outside the housing, through which interference signals can readily be coupled in, are avoided.

Naturally the configurations of the functional components described above can also be combined in any manner in order to fulfil several functions simultaneously.

BRIEF DESCRIPTION OF DRAWINGS

Other advantages and characteristics of this invention will be explained in the detailed description below with reference to the associated figures that contain several embodiments of this invention. It should however be understood, that the figure is just used to illustrate the invention and does not limit the scope of protection of the invention.

DETAILED DESCRIPTION OF THE INVENTION

Figure 1:
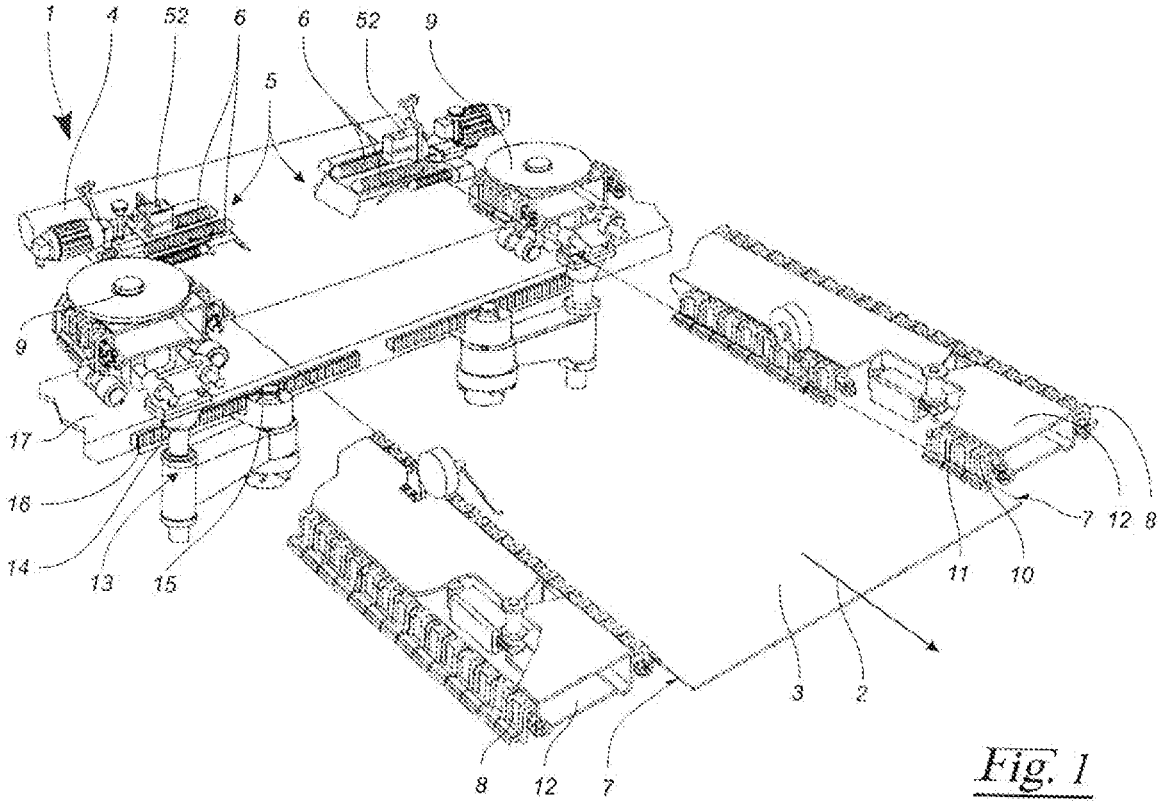
FIG. 1 shows a three-dimensional representation of a device for introducing a running material web into a tenter machine.

A device 1 according to FIG. 1 is used to introduce a material web 3 running in a web running direction 2. This material web 3 is in this case delivered to a tenter machine (not represented in the figure). For this purpose, the device 1 comprises a deflecting roll 4, which deflects the material web 3 into the desired web running direction 2. This deflecting roll 4 is followed by splaying devices 5, which comprise motor-driven threaded spreading rolls 6. These threaded spreading rolls 6 are in frictional contact with the running material web 3 and exert onto the material web 3, by the rotation and a thread pitch, forces which are directed towards edges 7 and which splay these edge regions. The effect achieved in this way is that the material web 3 is substantially smooth and does not have curled edges. This is important in particular for knitwear, which generally has a tendency to curling in the edge regions.

Immediately after the splaying devices 5, the running material web 3 is delivered to chains 8 which are guided around deflecting rollers 9. These chains may, in contrast to the representation according to FIG. 1, be arranged not only horizontally but also vertically. Furthermore, it is also conceivable to arrange the chains 8 in a plane arranged obliquely with respect to the horizontal. Of these deflecting rollers 9, only the pair on the feed side is respectively represented. The chains 8 are in this case configured endlessly and are motor-driven, in such a way that the speed thereof coincides with the web running speed of the running material web 3. The chains 8 comprise clamping arms 10 which grip the running material web 3 between their clamping jaws 11 with a friction and/or form fit. As an alternative, the chains 8 may also be equipped with pins. In this way, the running material web 3 has its movement synchronised in the respective regions of its edges 7 with the movement of the chains 8. In order to be able to precisely receive the running material web 3 and deliver it to the tenter machine, the chains 8 are held on tiltably mounted cheeks 12 so that the edges 7 of the running material web 3 run exactly onto the chains 8. In this way, location guiding of the running material web 3 is achieved, which is important for the subsequent tenter machine.

The location of the cheeks 12 is regulated in such a way that the respective edge 7 of the material web 3 is aligned with the chain 8. For this purpose, edge sensors 52 which record the edge length of the material web 3 and deliver it to a regulator (not represented) are provided. These edge sensors 52 are firmly connected to the cheeks 12, so that they record the edge 7 of the material web 3 relative to the cheek position. In this way, the edge sensors 52 immediately indicate a feed error of the edge 7 relative to the cheeks 12. This feed error is adjusted to the setpoint value 0 by the regulator in order to achieve optimal feed, in particular without distortion, of the material web 2 to the cheeks 12 in the stabilised regulating state.

In order to set each of the cheeks 12, a control element 13 is respectively provided, which is tiltably supported by means of a tilting bearing 14 on the respective cheek 12 and is tiltably supported by means of a tilting bearing on a frame 17. An actuator, the pinion 15 of which meshes with a rack 16 that is fitted on the frame 17 fixed to the machine, is provided in this control element 13. By rotation of the pinion 15, it rolls along the rack 16 so that a pinion shaft is displaced transversely with respect to the web running direction 2. Because of the coupling of the control element 13 to the cheek 12, the latter is thereby tilted in order to adapt an angle of attack of the chain 8 to the web running direction 2.

The specific structure of the control element 13 will be explained in more detail with the aid of FIGS. 2 and 3. The control element 13 comprises a housing 18, on which the tilting bearing 14 for support on the cheek 12 is held. An actuator 19, which drives the pinion 15 represented in FIG. 4 by means of gearing 20, is furthermore provided in the control element 13. Opposite the pinion 15 there is an interlock 21 which is formed by ball bearings 22. This interlock 21 forms a counter-bearing for the control element 13, which engages behind the frame 17 and thereby ensures that the pinion 15 meshes correctly with the rack 16. In this way, the ball bearings 22, or the interlock 21, may be configured to be self-adjusting per se in order to hold without play the counter-bearing that is formed. The pinion 15 and the interlock 21 are supported on a plate 23, which can be tilted by a tilting bearing and ensures that axes 24 of the pinion 15 and of the ball bearings 22 remain aligned relative to one another. Because of the geometrical arrangement of the pinion 15 and of the interlock 21, the plate 23 follows the frame 17 exactly, regardless of the angular location which the control element 13 occupies.

Magnetic strips 30, which cooperate with magnetic sensors 31 that are firmly connected to the housing 18 of the control element 13 and together form angle sensors 32, are arranged on the tilting bearing 14 and on the plate 23. As an alternative, optical sensors may also be used. In this case, the magnetic strips 30 are alternately poled so that, when the control element 13 is tilted, the magnetic sensors 31 supply an AC voltage signal from which the current angular location can be determined by counting the zero crossings. In order to be able to establish the direction of rotation as well, the magnetic strips 30 and/or the magnetic sensors 31 are duplicated, so that the direction of rotation can also be determined with the aid of the phase angle of the zero crossing. Hall sensors are preferably used as magnetic sensors 31.

Figure 2:
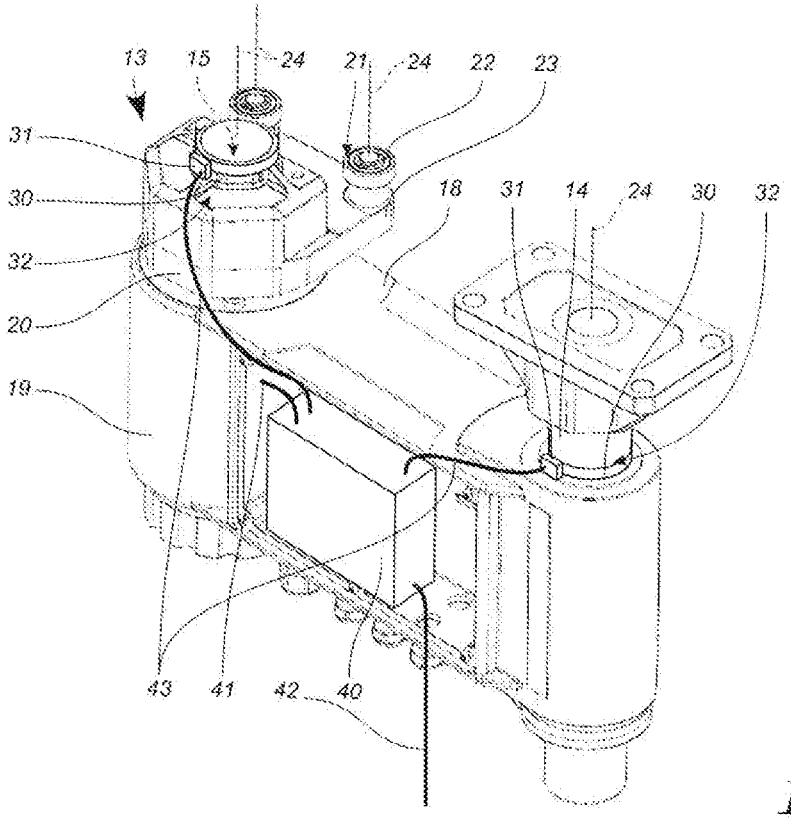
FIG. 2 shows a three-dimensional representation of a control element.
Figure 3:
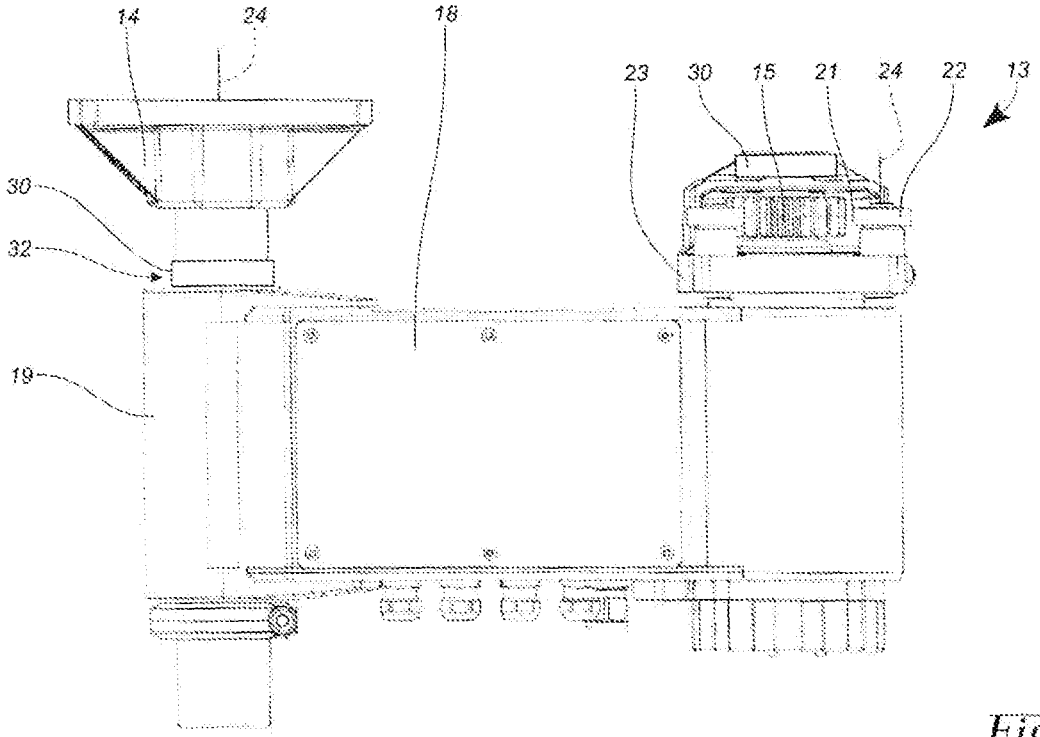
FIG. 3 shows a view of the control element according to FIG. 2 from behind.

The signals of the magnetic sensors 31 are delivered via signal paths 43 to an evaluation unit 40, which is likewise located inside the housing 18 of the control element 13 and can be seen in FIG. 2. The evaluation unit 40 is connected via a signal path 41 to the actuator 19 in order to drive it. Furthermore, the evaluation unit 40 is actively connected to the edge sensor 52, which generates the required location information of the running material web 3, via a further signal path 42.

Figure 4:
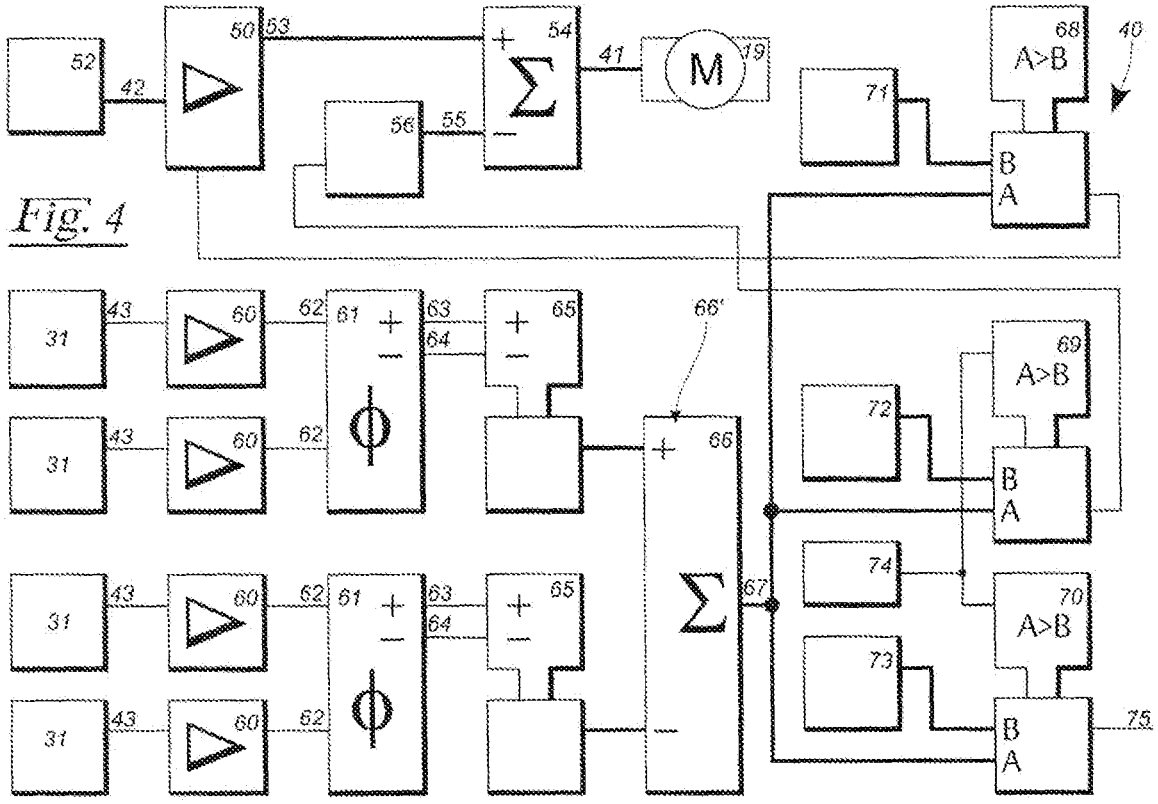
FIG. 4 shows a schematic representation of a circuit diagram of the evaluation unit.

The evaluation unit 40 will be explained in more detail with the aid of the outline circuit diagram according to FIG. 4. The edge location signal of the edge sensor 52 is delivered via the signal path 42 to a regulator 50, preferably with PID behaviour. At its output 53, the regulator 50 supplies a correction signal by which the actuator 19 is driven and the cheek 12 is therefore set.

Provided between the regulator 50 and the actuator 19, purely for the purpose of increasing the operational reliability, is an adder 54 which can subtract a constant but adjustable value from the output signal of the regulator 50. In general, that is to say in normal operating states, the adder 54 receives a zero signal at its non-inverting input 55 so that the entire adder 54 is inactive in this operating state and the signal at the output 53 of the regulator 50 is forwarded unchanged via the signal path 41 to the actuator 19.

The magnetic sensors 31 are actively connected via signal amplifiers 60 to a phase detector 61. This phase detector 61 records zero crossings at its inputs 62, including the phase angle of these zero crossings. Depending on which of the two inputs 62 the zero crossing with a positive flank occurs at first, a clock signal is output either on its plus output 63 or on its minus output 64. This indicates that the magnetic sensors 31 have moved forwards by one polarity period either in the plus direction or in the minus direction. In this way, the rotation angle on the one hand of the tilting bearing 14 and on the other hand of the tiltable plate 23 is recorded with a high accuracy. In order to be able to determine the actual rotation angle, the plus output 63 and the minus output 64 are connected to a bidirectional counter 65. This bidirectional counter 65 counts only the flanks of the plus output 63 upwards and of the minus output 64 downwards, so that its counter state is proportional to the angle actually present.

The described circuit parts of the magnetic sensors 31 up to the bidirectional counter 65 are duplicated in order to record on the one hand the rotation angle of the tilting bearing 14 and on the other hand the rotation angle of the tiltable plate 23. They are in principle constructed identically and will therefore not additionally be described in detail. The outputs of the two bidirectional counters are delivered to an adder 66, which records the difference of the two counter states and forms calculation means 66'. This differential angle corresponds to the actual cheek angle to within an additive correction value, which is not important in what follows. It is in principle also conceivable to omit the adder 66 by replacing the two bidirectional counters 65 with a single bidirectional counter 65, which then has two upward counting inputs and two downward counting inputs that are connected to the corresponding phase detectors 61. It has been found that although this measure saves on resources, it entails the risk of counting pulses being lost. This is, in particular, because the counting pulses occur entirely asynchronously and may therefore even occur virtually simultaneously. This leads to undefined states in the counter circuit, which then causes counting pulse losses. Since this is a safety-relevant component which is intended to record the respective angular location of the control element 13 exactly at any instant, this simplification is generally not acceptable.

An output 67 of the adder 66 is compared by means of a comparator 68, 69, 70 with threshold values of threshold value generators 71, 72, 73. The threshold value generators 71, 72, 73 may in the simplest case be potentiometers which output analogue voltages. As the threshold value generators 71, 72, 73, it is however also conceivable to provide a numerical keypad or a communication link via which the data entry to the threshold value generators 71, 72, 73 is made possible by means of a terminal (not represented). In this case, the comparison is carried out insofar as an active signal is output when the value at the output 67 is greater than the respective threshold value. In this way, critical operating states of the cheek 12 are established.

If the value at the output 67 is not greater than each of the threshold values of the threshold value generators 71, 72, 73, the operating state is a normal operating state so that the regulation by means of the regulator 50 can operate by any desired setting of the cheek 12. In this operating state, a zero value is delivered to the adder 54 so that the signal of the regulator at its output 53 is delivered unchanged to the actuator 19 via the signal path 41.

If the signal at the output 67 exceeds the threshold value of the threshold value generator 71, the comparator 68 transmits a signal to the regulator 50, by which the output value of the regulator 50 is kept. If regulation deviations which travel via the signal path 42 to the regulator 50 subsequently occur, the latter will no longer react to these regulation deviations and also the cheek 12 will therefore not be set further by means of the actuator 19. This effect then takes place in such a way that although the regulator 50 can set the cheek 12 in the direction of its neutral position lying parallel to the web running direction 2, it cannot do so in the opposite direction. This avoids the cheek 12, the material web 3 or the subsequent tenter machine from being damaged by excessive tilting of the cheek 12. If the fault which has triggered this exceptional situation is intended to be eliminated by itself, the regulator 50 will reduce its signal at the output 53 so that the limiting action of the comparator 68 is removed. The evaluation unit 40 therefore returns automatically into the normal operating state with self-eliminating faults.

It may occur that the cheeks are tilted further despite the aforementioned limitation, so that the operating state of the entire device 1 may become critical. This occurs particularly if a width setting of the tenter machine is carried out and the limiting effect of the comparator 68 is thereby removed.

For this purpose, the second comparator 69 is provided, which compares the signal at the output 67 with a somewhat higher threshold value. At its output 75, this comparator 69 outputs a signal which is zero in the normal but inactive state, although when the threshold value of the threshold value generator 72 is exceeded it supplies a value predeterminable by a generator 56 to the adder 54. In this way, the output signal of the regulator 50 is reduced by this predetermined value so that the cheek 12 is forced to be tilted back by this value in the direction of the neutral setting. The generator 56 may be produced in a similar way to the threshold value generators 71, 72, 73 or else differently.

In this way, the situation is alleviated after the cheek 12 has been forced to be tilted back in the direction of the neutral location under the effect of the comparator 69.

If the measures—due to the comparator 69—do not also show the required effect, it may be assumed that there is a particularly serious fault which makes it impossible to operate the equipment as a whole. For this purpose, the signal at the output 67 of the adder 66 is compared with a third threshold value in the comparator 70, which, if this threshold value is exceeded, then transmits a highly prioritised signal via the output 75 to the subsequent tenter machine so that the latter is turned off. This state may be removed only by means of the reset 74.

Preferably, the evaluation unit 40 as a whole or parts thereof are produced in the form of a microcontroller. This simplifies the structure of the evaluation unit 40. FIG. 4 represents signal paths which are to be configured in a multi-bit fashion with an increased line thickness.

Since some of the embodiments of this invention are not shown or described, it should be understood that a great number of changes and modifications of these embodiments is conceivable without departing from the rationale and scope of protection of the invention as defined by the claims.

What is claimed is:

1. A device for introducing a running material web into a tenter machine, said device comprising at least one tiltable cheek which receives said material web, said at least one cheek being tiltable by means of at least one control element having at least one actuator which engages on one hand on a fixed frame and on other hand on said at least one cheek, and measuring means for recording a tilt angle of said at least one cheek being provided, wherein said measuring means comprise angle sensors, of which one records an angle between said at least one cheek and said at least one control element and one records an angle between said at least one control element and said frame, and calculation means which calculate a difference of the two recorded angles are provided.

2. The device according to claim 1, wherein said at least one of said angle sensors is an analogue sensor.

3. The device according to claim 1, wherein said at least one of said angle sensors is a digital sensor which can output more than two different angle values.

4. The device according to claim 3, wherein said at least one of said angle sensors can output more than four different angle values.

5. The device according to claim 1, wherein said calculated difference is compared with at least one first threshold value, further tilting of said at least one cheek being prevented when said first threshold is exceeded.

6. The device according to claim 1, wherein said calculated difference is compared with at least one second threshold value, said at least one cheek being tilted into a location which lies closer to a neutral location in said web running direction when said second threshold is exceeded.

7. The device according to claim 1, wherein said calculated difference is compared with at least one third threshold value, an alarm signal being transmitted to said tenter machine when said third threshold is exceeded.

8. The device according to claim 1, wherein said device comprises at least one further sensor, which records said angle of said at least one cheek relative to said frame.

9. The device according to claim 8, wherein said further sensor is used for plausibility checking of said angle sensors.

* * * * *